US008991982B2

(12) United States Patent
Yamasaki

(10) Patent No.: US 8,991,982 B2
(45) Date of Patent: Mar. 31, 2015

(54) LIQUID EJECTING HEAD AND LIQUID EJECTING APPARATUS

(71) Applicant: Seiko Epson Corporation, Tokyo (JP)

(72) Inventor: Keigo Yamasaki, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/096,336

(22) Filed: Dec. 4, 2013

(65) Prior Publication Data

US 2014/0160206 A1 Jun. 12, 2014

(30) Foreign Application Priority Data

Dec. 10, 2012 (JP) ..... 2012-269193

(51) Int. Cl.

| | |
|---|---|
| ***B41J 2/04*** | (2006.01) |
| ***B41J 2/14*** | (2006.01) |
| ***B41J 2/055*** | (2006.01) |
| *B41J 2/19* | (2006.01) |

(52) U.S. Cl.

CPC ..... *B41J 2/14233* (2013.01); *B41J 2/055* (2013.01); *B41J 2002/14241* (2013.01); *B41J 2202/11* (2013.01)

USPC ..... 347/54; 347/92

(58) Field of Classification Search

CPC ..... B41J 2/19; B41J 2/14201; B41J 2/14145; B41J 2202/07; B41J 2/1626; B41J 2/1601

USPC ..... 347/20, 47, 65, 95, 100, 54

See application file for complete search history.

(56) References Cited

U.S. PATENT DOCUMENTS

| | | | | |
|---|---|---|---|---|
| 4,808,260 | A * | 2/1989 | Sickafus et al. | 216/2 |
| 6,273,539 | B1 * | 8/2001 | Suzuki | 347/12 |
| 6,302,524 | B1 * | 10/2001 | Roy | 347/46 |
| 6,527,370 | B1 * | 3/2003 | Courian et al. | 347/47 |
| 6,663,219 | B2 * | 12/2003 | Kubota et al. | 347/36 |
| 7,201,476 | B2 * | 4/2007 | Buchanan et al. | 347/87 |
| 7,467,468 | B2 * | 12/2008 | Imai | 29/890.1 |
| 7,712,679 | B2 * | 5/2010 | Onozawa | 239/102.1 |
| 7,806,518 | B2 * | 10/2010 | Nishikawa | 347/65 |
| 2004/0036739 | A1 * | 2/2004 | Delametter et al. | 347/54 |
| 2005/0190245 | A1 * | 9/2005 | Desie et al. | 347/100 |
| 2009/0244181 | A1 * | 10/2009 | Kurobe | 347/44 |
| 2009/0295870 | A1 * | 12/2009 | Goin et al. | 347/47 |
| 2012/0081468 | A1 * | 4/2012 | Ozawa et al. | 347/54 |

FOREIGN PATENT DOCUMENTS

| | | |
|---|---|---|
| JP | 08-258258 | 10/1996 |
| JP | 2009-029011 A | 2/2009 |

* cited by examiner

*Primary Examiner* — Matthew Luu
*Assistant Examiner* — Patrick King
(74) *Attorney, Agent, or Firm* — Harness, Dickey & Pierce, P.L.C.

(57) ABSTRACT

A liquid ejecting head includes a first member including a communication flow path communicating with a pressure chamber, and a second member joined to the first member and including a nozzle communicating with the communication flow path. The communication flow path includes a first flow path section adjacent to the pressure chamber, a second flow path section adjacent to the nozzle and wider than the first flow path section, and an intermediate flow path section including a sloped surface formed between the first flow path section and the second flow path section. An equation "$H-W\tan(\pi/4-\theta/2)\geq 0$" is satisfied in which H represents a length of the second flow path section, W represents a maximum width of the second flow path, and θ represents an angle between an imaginary plane parallel to the bottom face of the communication flow path and the sloped surface.

6 Claims, 9 Drawing Sheets

LIQUID EJECTING HEAD AND LIQUID EJECTING APPARATUS

BACKGROUND

1. Technical Field

The present invention relates to a liquid ejecting head that ejects ink through a nozzle, and a liquid ejecting apparatus incorporated with the liquid ejecting head.

2. Related Art

The liquid ejecting apparatus includes a liquid ejecting head, and is designed to eject various types of liquid from the ejecting head. An image recording apparatus, such as an ink jet printer or an ink jet plotter, is a typical example of the liquid ejecting apparatus, however recently the liquid ejecting head has come to be increasingly applied to various manufacturing apparatuses, because of the benefit in that a minute amount of liquid can be accurately shot onto a predetermined position. Such a liquid ejecting head is employed, for example, in display manufacturing apparatuses for manufacturing color filters for LCDs, electrode forming apparatuses for manufacturing electrodes for organic electroluminescence (EL) displays or field emission displays (FED), and chip manufacturing apparatuses for manufacturing biochips (biochemical elements). The recording head in the image recording apparatus ejects liquid ink, a color material ejecting head in the display manufacturing apparatus ejects solutions of color materials of red (R), green (G), and blue (B). An electrode material ejecting head in the electrode forming apparatus ejects a liquid electrode material, and a bioorganic ejecting head in the chip manufacturing apparatus ejects a solution of a bioorganic substance.

The liquid ejecting heads thus far developed include those having a pressure chamber substrate on which a pressure chamber is formed, a nozzle substrate including nozzle holes, and a communication substrate provided between the pressure chamber substrate and the nozzle substrate (for example as disclosed in JP-A-8-258258). These substrates are bonded together with an adhesive. The communication substrate includes a communication via communicating between the pressure chamber and the nozzles. The liquid ejecting head of such a type is configured to drive a piezoelectric element to change the pressure on the liquid in the pressure chamber, and thus ejects the liquid in the pressure chamber through the communication via out of the nozzle.

However, a part of the adhesive may be squeezed out from between the communication substrate and the nozzle substrate upon bonding these substrates together, and the adhesive that has been squeezed out may proceed upward (toward the pressure chamber) along a portion corresponding to the interior angle of the communication via, owing to a capillary effect. In such a case, after the communication substrate and the nozzle substrate are bonded together the adhesive that has cured remains on the inner wall of the communication via. In particular, the leading end portion of the adhesive that remains on the inner wall on the side of the central portion of the pressure chamber is prone to intrude in the pressure chamber, and the end portion of the adhesive may be scraped off by the liquid flowing from the pressure chamber toward the nozzle. In case that the adhesive thus scraped off sticks out from the nozzle, the ejection characteristics of the liquid droplet (amount, flying speed, and flying direction of the liquid droplet) ejected from the nozzle fluctuate, and besides the nozzle is prone to be clogged with the adhesive.

Accordingly, a remedy has been proposed as shown in FIGS. 8A and 8B, in which a sloped surface 96 is formed on one side of the inner wall of the communication via 92 (on the side of the central portion of the pressure chamber), so as to restrict the adhesive from proceeding further. More specifically, the communication via 92 in the communication substrate 90 is formed so as to include a first flow path section 93 on the side of the pressure chamber, a second flow path section 94 on the side of the nozzle 98 wider than the first flow path section 93, and an intermediate flow path section 95 connecting between the first flow path section 93 and the second flow path section 94 and including the sloped surface 96. With such a configuration, even though the adhesive proceeds upward along the inner wall of the second flow path section 94 upon bonding the communication substrate 90 and the nozzle substrate 91 together, the sloped surface 96 of the intermediate flow path section 95 serves to suppress the adhesive from proceeding further. As a result, the adhesive can be prevented from being scraped off, and therefore the fluctuation of the ejection characteristics of the liquid droplet ejected from the nozzle 98, as well as the clogging of the nozzle 98 can be prevented.

With the liquid ejecting head that includes the communication via 92 configured as above, however, an air bubble often resides in the communication via 92 in a region below the sloped surface 96, when the liquid is first loaded in the flow path (at the time of initial loading of the liquid). To be more detailed, when the liquid is supplied from the pressure chamber in the initial loading of the liquid, the liquid L proceeds downward from the upper portion of the first flow path section 93, as shown in FIG. 8A. At this point, the surface of the liquid L assumes a shape having an arcuate cross-section, because the peripheral edge of the liquid surface proceeds along the inner wall of the communication via 92 in contact therewith at a certain contact angle. Here, FIGS. 8A and 8B and FIGS. 9A to 9C represent a case where the contact angle of the liquid L with respect to the inner wall of the communication via 92 is smaller than 90 degrees, in other words where the communication substrate 90 has affinity with liquid. When a portion of the peripheral edge of the liquid surface reaches the sloped surface 96 of the intermediate flow path section 95, the liquid L turns the moving direction in an oblique direction as shown in FIG. 8B. Then the liquid L moves obliquely downward until the opposite edge of the liquid surface reaches the lower end of the second flow path section 94, i.e., the nozzle substrate 91, as shown in FIG. 9A. When the opposite edge of the liquid surface reaches the nozzle substrate 91, the opposite edge starts to move in the horizontal direction along the nozzle substrate 91 as shown in FIG. 9B and therefore the liquid L moves in a generally horizontal direction. When the opposite edge of the liquid surface reaches the nozzle 98, the liquid L is introduced into the nozzle 98 and thus the initial loading of the liquid L is completed. At this point, the communication via 92 is not entirely filled with the liquid L, and an air bubble b remains in a region below the sloped surface 96, as shown in FIG. 9C. The air bubble b thus formed in the communication via 92 often degrades the ink ejection performance.

SUMMARY

An advantage of some aspects of the invention is provision of a liquid ejecting head that suppresses formation of a residual air bubble when liquid is loaded in a flow path provided between a pressure chamber and a nozzle, and a liquid ejecting apparatus incorporated with such a liquid ejecting head.

An aspect of the invention provides a liquid ejecting head including a first member including a pressure chamber the volume of which varies by operation of a pressure generator and a communication flow path communicating with a downstream end portion of the pressure chamber; a second member including a nozzle communicating with the communication flow path and joined to a face of the first member thus constituting a bottom face of the communication flow path. The communication flow path includes a first flow path section located on the side of the pressure chamber, a second flow path section located on the side of the nozzle and wider than the first flow path section, and an intermediate flow path section including a sloped surface formed between the first flow path section and the second flow path section, and an equation "$H-W\tan(\pi/4-\theta/2)\geq 0$" is satisfied in which H represents a length of the second flow path section, W represents a maximum width of the second flow path, and θ represents an angle between an imaginary plane parallel to the bottom face of the communication flow path and the sloped surface.

In another aspect, the invention provides a liquid ejecting head including a first member including a pressure chamber the volume of which varies by operation of a pressure generator and a communication flow path communicating with a downstream end portion of the pressure chamber; a second member including a nozzle communicating with the communication flow path and joined to a face of the first member thus constituting a bottom face of the communication flow path. The communication flow path includes a first flow path section located on the side of the pressure chamber, a second flow path section located on the side of the nozzle and wider than the first flow path section, and an intermediate flow path section including a sloped surface formed between the first flow path section and the second flow path section, and an equation "$h/w\geq(W^2-H^2)/(2HW)$" is satisfied in which H represents a length of the second flow path section, W represents a maximum width of the second flow path, h represents a length of the intermediate flow path section, and w represents a difference in width in the intermediate flow path section.

In the thus-configured liquid ejecting head, the communication flow path is formed so as to satisfy either of the aforementioned equations. Therefore, formation of a residual air bubble can be suppressed when the liquid is loaded in the flow path provided between the pressure chamber and the nozzle.

It is preferable that the following equation is satisfied, in which ϕ represents a contact angle of the liquid flowing in the communication flow path with respect to an inner wall of the communication flow path, and T represents a minimum width of the second flow path taken in a direction intersecting the direction of the maximum width:

$$H-W\tan(\pi/4-\theta/2)\geq(T/2)\times(1/\cos\phi-\tan\theta)$$

In this case, the communication flow path is formed so as to satisfy the equation cited above, and therefore formation of a residual air bubble in the communication flow path can be more effectively suppressed when the liquid is loaded in the flow path provided between the pressure chamber and the nozzle.

Further, the invention provides a liquid ejecting apparatus incorporated with either of the foregoing liquid ejecting heads.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, embodiments of the invention will be described referring to the accompanying drawings. Although various limitations are mentioned regarding the following embodiments as preferred form of the invention, it is to be understood that the invention is in no way limited to such embodiments unless otherwise noted expressly. In the description given hereunder, the liquid ejecting apparatus according to the invention will be exemplified by an ink jet printer (hereinafter, simply "printer") that includes an ink jet recording head (hereinafter, simply "recording head"), which is an example of the liquid ejecting head.

Figure 1:
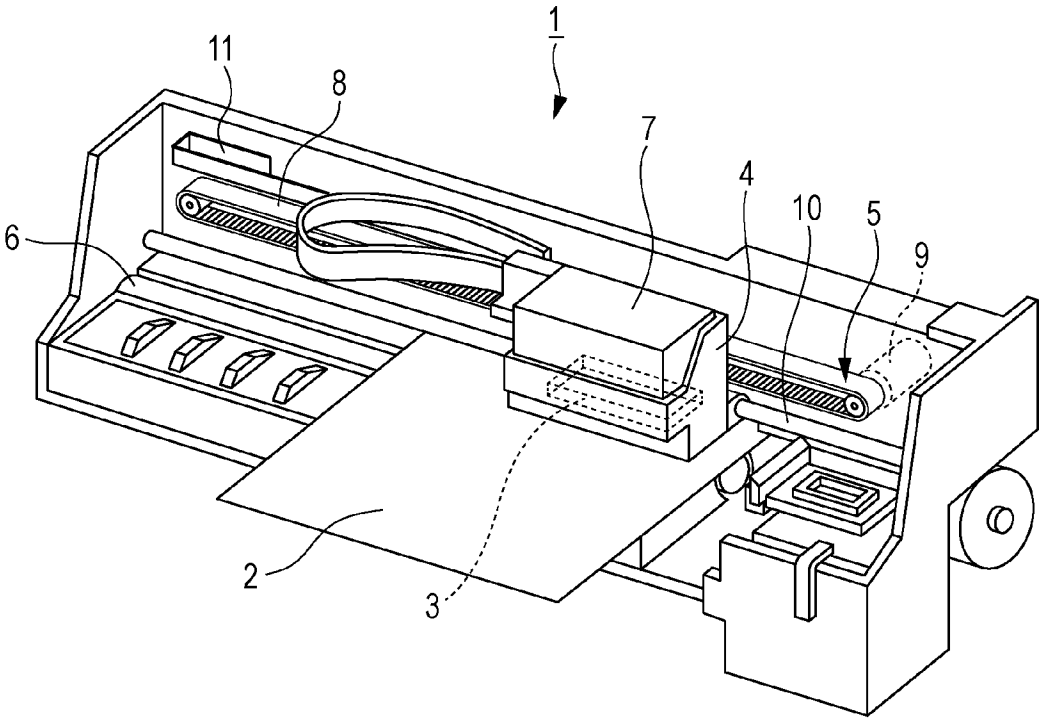
FIG. 1 is a perspective view for explaining a configuration of a printer.

Referring to FIG. 1, the configuration of the printer 1 will be described. The printer 1 is designed to eject liquid ink onto the surface of a recording medium 2 such as a recording sheet, to thereby record images and characters. The printer 1 includes a recording head 3, a carriage 4 on which the recording head 3 is mounted, a carriage moving mechanism 5 that moves the carriage 4 in the main scanning direction, and a transport mechanism 6 that transports the recording medium 2 in the sub scanning direction. Examples of the ink that can be employed in the printer 1 include a solvent-based ink predominantly composed of an organic solvent, and an aqueous ink predominantly composed of water, and such ink is stored in an ink cartridge 7 that serves as a liquid supply source. The ink cartridge 7 is removably mounted on the recording head 3 (holder 14 to be described later). Here, the ink cartridge 7 may be located in the main body of the printer 1, and the ink may be supplied from the ink cartridge 7 to the recording head 3 through an ink supply tube.

The carriage moving mechanism 5 includes a timing belt 8, which is driven by a DC pulse motor 9. When the pulse motor 9 is activated, the carriage 4 is made to reciprocate in the main scanning direction (width direction of the recording medium 2), guided by a guide rod 10 disposed so as to span over the printer 1. The position of the carriage 4 in the main scanning direction is detected by a linear encoder 11, and the detection signal, i.e., the encoder pulse is transmitted to a control unit (not shown) of the printer 1. A home position, i.e., the initial position of the scanning motion of the carriage 4, is set in an end portion of the stroke range of the carriage 4, at a position outside of the recording region in the stroke range. The printer 1 is configured to perform a bidirectional recording, in which the recording of characters and images is performed on a recording sheet 5, both during the forward movement of the carriage 4 from the home position to the opposite end, and during the backward movement from the opposite end to the home position.

Figure 2:
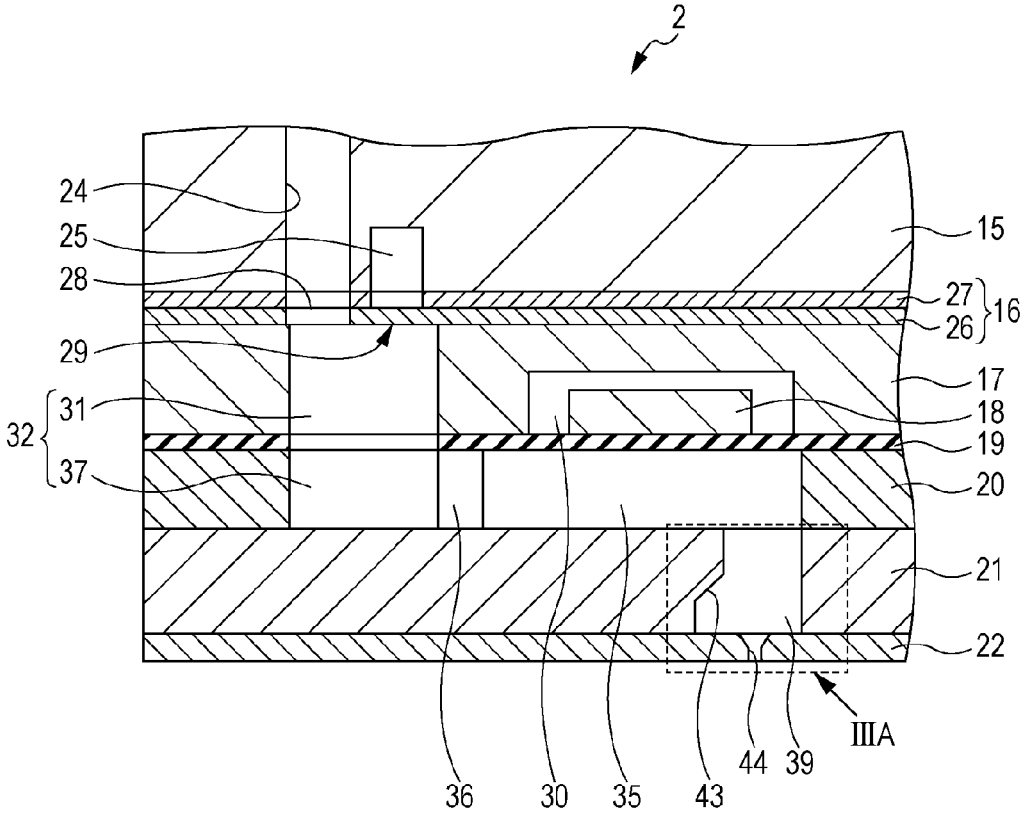
FIG. 2 is a cross-sectional view showing an essential portion of a recording head.

The recording head 2 will now be described hereunder. FIG. 2 is a cross-sectional view showing an essential portion of the recording head 2. The recording head 2 according to this embodiment includes a head case 15, a compliance substrate 16, a cover substrate 17, a piezoelectric element 18 corresponding to the pressure generator in the invention, a vibration plate 19, a flow path substrate 20, a communication substrate 21, and a nozzle substrate 22, stacked on one another. For the sake of clarity, the side of the head case 15 will be referred to as upper side, and the side of the nozzle substrate 22 will be referred to as lower side in the following description. The mentioned substrates are bonded to each other via an adhesive.

The head case 15 includes a case flow path 24 through which the ink is supplied from the ink cartridge 3 to a reserver 32 to be subsequently described. The case flow path 24 has the lower end portion communicating with the top portion (ceiling portion) of the reserver 32, and the upper end portion communicating with an ink supply needle (not shown) connected to the ink cartridge 3. A sealed space 25, having a size sufficient to allow flexural deformation of a sealing film 26, is provided in a portion of the lower face of the head case 15 opposing a sealing portion 29 (to be subsequently described) of the compliance substrate 16.

The compliance substrate 16 is bonded to the lower face of the head case 15, and composed of a flexible sealing film 26 and a fixed substrate 27 formed of a hard material such as a metal and superposed on the sealing film 26. The compliance substrate 16 includes an ink inlet 28 through which the ink is introduced into the reserver 32, formed so as to penetrate through the compliance substrate 16 in the thickness direction thereof. The region on the compliance substrate 16 opposing the reserver 32 except for the ink inlet 28 constitutes the sealing portion 29 that only includes the sealing film 26, without the fixed substrate 27. Accordingly, the reserver 32 is sealed with the flexible sealing portion 29, and thus attains compliance.

The cover substrate 17 includes a piezoelectric element chamber 30 formed in a region opposing the piezoelectric element 18, and is bonded to the lower face of the compliance substrate 16, the piezoelectric element chamber 30 having a size sufficient for allowing the displacement of the piezoelectric element 18. The cover substrate 17 includes an introduction cavity 31 formed so as to penetrate therethrough in the thickness direction, at a position opposing a communication cavity 37 of the flow path substrate 20 to be subsequently described. The introduction cavity 31 communicates with the communication cavity 37, thus constituting the reserver 32 from which the ink is supplied to a pressure chamber 35.

The vibration plate 19 is an elastic substrate composed of an elastic film and an insulator film stacked on each other, and bonded to the lower face of the cover substrate 17. The vibration plate 19 includes an opening formed so as to penetrate therethrough in the thickness direction, at the position opposing the introduction cavity 31, the opening communicating between the introduction cavity 31 and the communication cavity 37. The piezoelectric element 18 is composed of a lower electrode layer, a piezoelectric layer, and an upper electrode layer stacked in this order, and placed on the vibration plate 19 (insulator film) at the position corresponding to the pressure chamber 35 of the flow path substrate 20 to be subsequently described. A non-illustrated wiring is connected to the piezoelectric element 18, and a driving signal (driving voltage) from the control unit is applied to the piezoelectric element 18 through the wiring. Upon applying the driving signal, the piezoelectric element 18 is flexurally deformed so as to change the volume of the pressure chamber 35.

The flow path substrate 20 is formed of silicon monocrystal or stainless steel, and bonded to the lower face of the vibration plate 19. The flow path substrate 20 includes the communication cavity 37, the pressure chamber 35, and an ink supply path 36, all of which are formed so as to penetrate through the flow path substrate 20 in the thickness direction. The communication cavity 37 is located at the position corresponding to the introduction cavity 31, and constitutes the reserver 32 together with the introduction cavity 31. The pressure chamber 35 is an elongate cavity extending in a direction orthogonal to the nozzle row, and a plurality of pressure chambers 35 are provided so as to respectively correspond to the nozzles 44. The pressure chamber 35 communicates with the communication cavity 37 (reserver 32) through the ink supply path 36 which is narrower than the pressure chamber 35.

The communication substrate 21 is formed of silicon monocrystal or stainless steel, and bonded to the lower face of the flow path substrate 20. The communication substrate includes a communication via 39 (corresponding to the communication flow path in the invention) penetrating therethrough in the thickness direction and communicating between the pressure chamber 35 and the nozzle 44. The communication via 39 is located in the region of the communication substrate 21 opposing the pressure chamber 35, at and end portion of that region opposite the ink supply path 36 (reserver 32), i.e., the downstream end portion. The communication via 39 according to this embodiment has a rectangular shape when viewed from the interface between the flow path substrate 20 and the communication substrate 21, and is wider in the extending direction of the pressure chamber 35 (orthogonal to the nozzle row) than in the direction orthogonal to the extending direction of the pressure chamber 35 (direction along the nozzle row). In addition, the communication via 39 includes a sloped surface 43 formed on halfway of the inner wall thereof on the side of the central portion of the pressure chamber 35 (on the left in FIG. 2), such that the width of the communication via 39 in the extending direction of the pressure chamber 35 increases toward a lower position. Further details of the configuration of the communication via 39 will be subsequently described. Here, the flow path substrate 20 and the communication substrate 21 bonded together constitute the first member in the invention.

The nozzle substrate 22, corresponding to the second member in the invention, is formed of silicon monocrystal or stainless steel and bonded to the lower face of the communication substrate 21. The nozzle substrate 22 defines the communication via 39, serving as the bottom face thereof. The nozzle 44 is located at a generally central position of the bottom face of the communication via 39. The plurality of nozzles 44 are aligned at intervals corresponding to a predetermined dot density. For example, the nozzle row may be composed of 360 pieces of nozzles 44 corresponding to the density of 360 dpi.

To bond the communication substrate 21 and the nozzle substrate 22 together, an epoxy-based adhesive of a liquid phase may be employed. The adhesive is applied to the lower face of the communication substrate 21 by transfer printing or the like. Now, in conventional liquid ejecting heads, a part of the adhesive that has been squeezed out from the communication via 39 upon bonding the communication substrate 21 and the nozzle substrate 22 may proceed upward along a portion corresponding to the interior angle of the communication via 39. The upper portion of the inner wall of the communication via 39 on the side of the central portion of the pressure chamber 35 (on the left in FIG. 2) is orthogonal to the bottom face of the pressure chamber 35, and hence the leading end portion of the adhesive proceeding upward along the inner wall is prone to be exposed at the bottom face of the pressure chamber 35. After the adhesive has cured, such exposed portion of the adhesive may be scraped off by the flow of the ink. In this embodiment, however, since the communication via 39 includes the sloped surface 43 formed on halfway of the inner wall thereof on the side of the central portion of the pressure chamber 35 as stated above, the adhesive is suppressed from proceeding further upward along the inner wall. Therefore, the adhesive can be prevented from being scraped off in the communication via 39. In contrast, the inner wall of the communication via 39 opposite the sloped surface 43 (on the right in FIG. 2) is flush with the inner wall of the pressure chamber 35 opposite the ink supply path 36 (downstream inner wall), and hence the adhesive proceeding upward along the inner wall of the communication via 39 is connected to the adhesive provided between the flow path substrate 20 and the communication substrate 21. Therefore, the adhesive on the inner wall opposite the sloped surface 43 is less likely to be scraped off.

In the recording head 2 configured as above, when the ink cartridge 3 is connected in the manufacturing process or at the time of replacement of the ink cartridge 3, the ink stored in the ink cartridge 3 is introduced into the case flow path 24, the ink inlet 28, the reserver 32, the ink supply path 36, the pressure chamber 35, the communication via 39, and into the nozzle 44. Upon driving the piezoelectric element 18 in this state, the ink in the pressure chamber 35 is subjected to pressure fluctuation because of a change in volume of the pressure chamber 35, thus to be ejected from the nozzle 44 through the communication via 39.

Figure 3A:
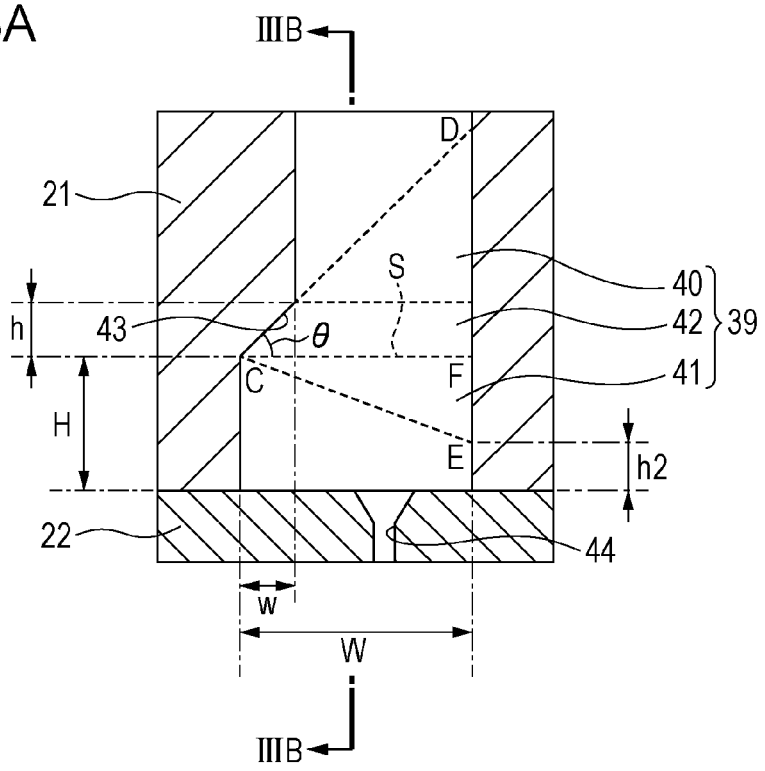
FIG. 3A is an enlarged cross-sectional view of a portion marked as IIIA in FIG. 2.
Figure 3B:
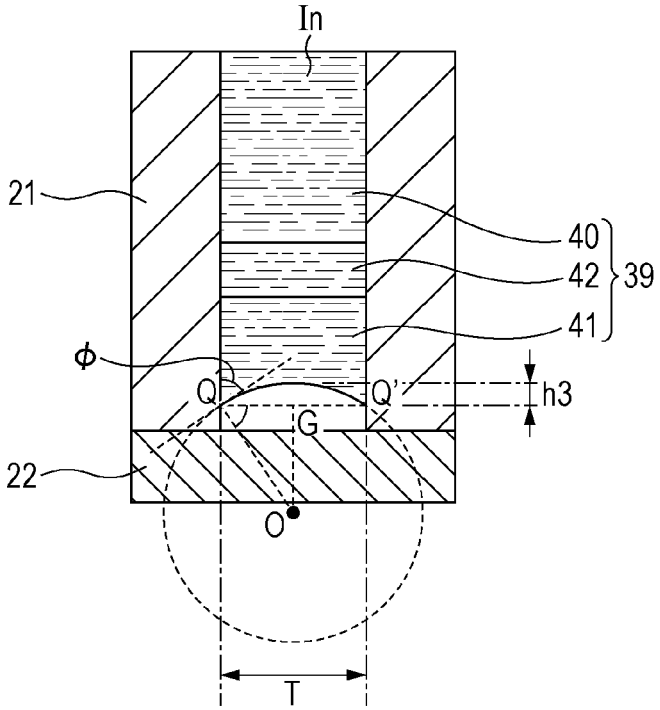
FIG. 3B is a cross-sectional view taken along a line IIIB-IIIB in FIG. 3A.

The communication via 39 according to this embodiment will be described in further details hereunder. FIG. 3A is an enlarged cross-sectional view of a portion marked as IIIA in FIG. 2, and FIG. 3B is a cross-sectional view taken along a line IIIB-IIIB in FIG. 3A. For the sake of clarity of the description, FIG. 3B illustrates a state where the communication via 39 is halfway filled with the ink In.

The communication via 39 includes a first flow path section 40 located on the side of the pressure chamber 35, a second flow path section 41 located on the side of the nozzle 44 and wider than the first flow path section 40 in the extending direction of the pressure chamber 35 (orthogonal to the nozzle row), and an intermediate flow path section 42 including the sloped surface 43 formed between the first flow path section 40 and the second flow path section 41. The first flow path section 40 extends from the upper end portion of the communication via 39 (on the side of the pressure chamber 35) to halfway of the communication substrate 21 in a direction orthogonal to the surface of the communication substrate 21 (nozzle substrate 22). In other words, the inner wall defining the first flow path section 40 is oriented orthogonal to the surface of the communication substrate 21. The second flow path section 41 extends from the lower end portion of the communication via (on the side of the nozzle 44) to halfway of the communication substrate 21 in the direction orthogonal to the surface of the communication substrate 21 (nozzle substrate 22). In other words, the inner wall defining the second flow path section 41 is oriented orthogonal to the surface of the communication substrate 21. The intermediate flow path section 42 includes the sloped surface 43, which is a portion obliquely inclined formed on the inner wall of the communication via 39 on the side of the central portion of the pressure chamber 35 (on the left in FIGS. 3A and 3B), and the remaining portion of the inner wall of the intermediate flow path section 42 is oriented orthogonal to the surface of the communication substrate 21. The sloped surface 43 extends between the inner walls of the first flow path section 40 and the second flow path section 41 on the side of the central portion of the pressure chamber 35, and is downwardly inclined toward the central portion of the pressure chamber 35. In contrast, the inner wall of the first flow path section 40 except for the portion adjacent to the sloped surface 43, the inner wall of the intermediate flow path section 42 except for the sloped surface 43, and the inner wall of the second flow path section 41 except for the portion adjacent to the sloped surface 43 are flush with each other in the plane of the communication substrate 21, and steplessly connected to each other. Therefore, the flow path sections 40 to 42 have the same width in the direction orthogonal to the extending direction of the pressure chamber 35 (direction of the nozzle row), as shown in FIG. 3B. Here, the width of the flow path sections 40 to 42 in the mentioned direction is narrower than the width thereof in the extending direction of the pressure chamber 35.

Referring to FIG. 3A, the communication via 39 is configured so as to satisfy the following equation (1) in which H represents a length (height) of the second flow path section 41, W represents a maximum width of the second flow path 41 (width in the extending direction of the pressure chamber 35), and θ represents an angle between an imaginary plane S parallel to the bottom face of the communication via (interface between the intermediate flow path section 42 and the second flow path section 41) and the sloped surface 43:

$$H-W\tan(\pi/4-\theta/2)\geq 0 \quad (1)$$

Here, the condition equivalent to the equation (1) cited above can be expressed as the following equation (2), in which h represents a length of the intermediate flow path section 42, and w represents a difference in width in the intermediate flow path section 42 (difference between the maximum width of the second flow path section 41 and the maximum width of the first flow path section 40). Therefore, the communication via 39 is also configured so as to satisfy the following equation (2):

$$h/w\geq(W^2-H^2)/(2HW) \quad (2)$$

The configuration described above suppresses formation of a residual air bubble in the communication via 39, when the ink is first introduced into the flow path formed as far as the nozzle 44 (initial loading of the ink). In particular, it is preferable that the communication via 39 is configured so as to satisfy the following equation (3) in which, as shown in FIG. 3B, ϕ represents a contact angle of the liquid flowing in the communication via 39 with respect to the inner wall thereof, and T represents a minimum width of the second flow path section 41 in a direction intersecting the direction of the maximum width thereof, i.e., the width in the direction orthogonal to the extending direction of the pressure chamber 35:

$$H-W\tan(\pi/4-\theta/2)\geq(T/2)\times(1/\cos\phi-\tan\phi) \quad (3)$$

Such a configuration further assures that formation of a residual air bubble is suppressed in the communication via 39, at the time of the initial loading of the ink.

Figure 4A:
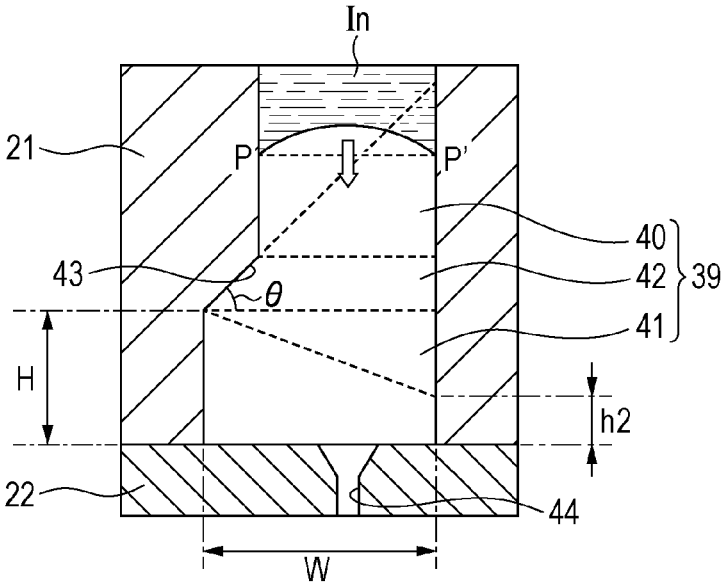
FIGS. 4A and 4B are cross-sectional views for explaining how ink is introduced into a communication via, according to an embodiment of the invention.

Now, explanation will be given hereunder regarding the basis of the equations (1) to (3) and how these equations are led out. Referring to FIGS. 3A to 7B, the equation (1) will first be explained. Here, the embodiment shown in FIGS. 3A to 7B represents the case where the contact angle of the ink In with respect to the inner wall of the communication via 39 is smaller than 90 degrees, i.e., where the communication substrate 21 has affinity with the ink. The embodiment shown in FIGS. 4A to 5C will first be described. The communication via 39 according to this embodiment is configured so as to satisfy the equations (1) to (3). When the ink In is sequentially introduced from the upstream ones of the flow paths in the recording head 2 and reaches the communication via 39 in the initial loading process of the ink In, the ink In starts to move downward in the first flow path section 40, as shown in FIG. 4A. The liquid surface of the ink In (interface with air) moves downward such that the edges on the respective sides of the liquid surface maintain the contact angle with respect to the inner wall of the communication via 39, and hence assumes a shape having an arcuate cross-section protruding upward. Referring to the cross-section of the communication via 39 shown in FIG. 4A, the contact angle at a point P and the contact angle at a point P' are equal, where the point P represents the intersection between the edge of the liquid surface of the ink In on one side (left in FIG. 4A) and the inner wall of the communication via 39, and the point P' represents the intersection between the edge of the liquid surface of the ink In on the opposite side (right in FIG. 4A) and the inner wall of the communication via 39, and therefore the liquid surface of the ink In becomes vertically symmetrical (with respect to the center line between the inner walls on the respective sides of the first flow path section 40). In addition, an imaginary line drawn between P and P' becomes parallel to the nozzle substrate 22.

Figure 4B:
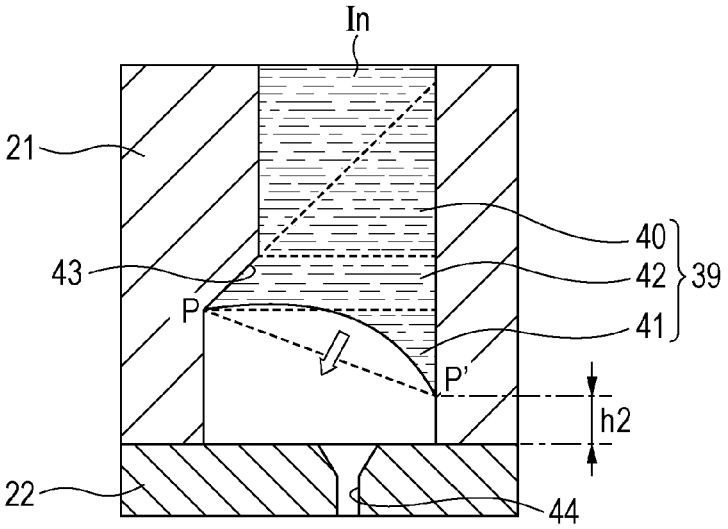
Figure 5A:
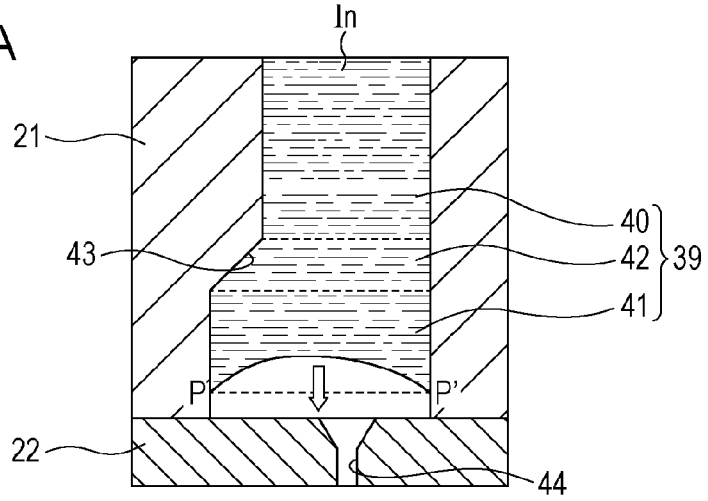
FIGS. 5A to 5C are cross-sectional views for explaining how ink is introduced into the communication via, according to the embodiment.

When the ink In moves further and a side edge (point P) of the liquid surface of the ink In reaches the sloped surface 43, the moving direction of the liquid surface is obliquely turned as shown in FIG. 4B. In other words, the imaginary line drawn between P and P' is obliquely inclined with respect to the nozzle substrate 22 because the liquid surface moves such that the contact angle at the point P and the contact angle at the point P' remain equal to each other. At this point, in the cross-section of the communication via 39, the liquid surface of the ink In becomes vertically symmetrical with respect to a line passing the midpoint between the sloped surface 43 and the inner wall opposing the sloped surface 43 (surface continuously extending from the inner wall of the first flow path section 40 to the inner wall of the second flow path section 41). Then when the side edge (point P) of the liquid surface of the ink In reaches the lower end of the sloped surface 43, the opposite side edge (point P') of the liquid surface of the ink In is located halfway of the second flow path section 41, at a position spaced by a distance h2 from the upper surface of the nozzle substrate 22 (bottom face of the communication via 39) as shown in FIG. 4B. Accordingly, when the side edge (point P) of the liquid surface of the ink In reaches the inner wall of the second flow path section 41, the opposite side edge (point P') of the liquid surface of the ink In remains on the inner wall of the second flow path section 41 instead of reaching the bottom face of the communication via 39, as shown in FIG. 5A. To be more detailed, in the cross-section of the communication via 39, since the contact angle at the point P and the contact angle at the point P' are maintained equal to each other, the liquid surface of the ink In becomes vertically symmetrical with respect to a line passing the midpoint between the inner walls on the respective sides of the second flow path section 41), as when the liquid surface of the ink In was located in the first flow path section 40, and thus the imaginary line drawn between P and P' becomes parallel to the nozzle substrate 22.

Figure 5B:
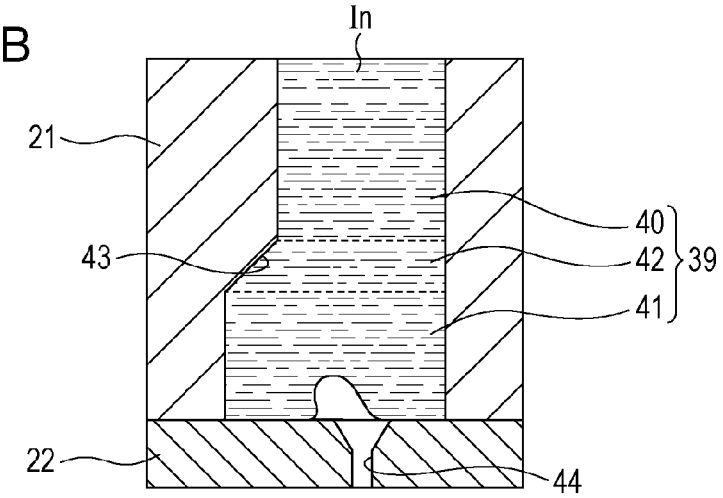
Figure 5C:
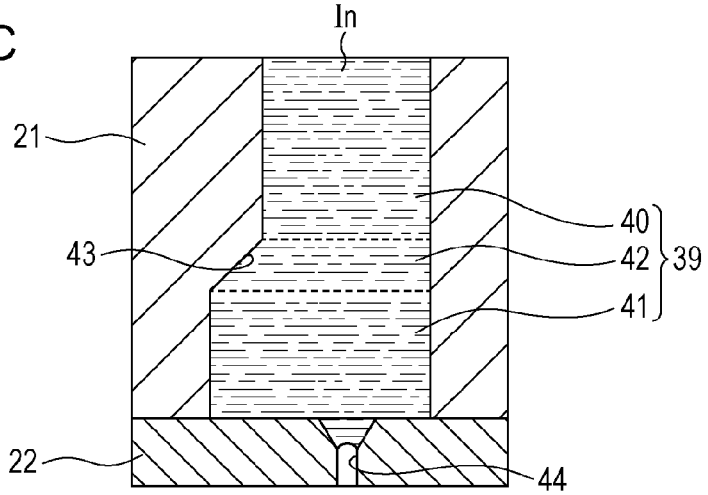

When the ink In moves further downward, the edges of the liquid surface of the ink In first reach the bottom face of the communication via 39 and, as shown in FIG. 5B, the ink In occupies the space on the bottom face from the peripheral region toward the central region, discharging air through the nozzle 44. When generally the entirety of the air in the communication via 39 is discharged through the nozzle 44 as shown in FIG. 5C, the loading of the ink In is completed. The ink In proceeds to halfway of the nozzle 44 and forms a meniscus.

As described above on the basis of the cross-section of the communication via 39, unlike the conventional liquid ejecting head shown in FIGS. 8A to 9C, when the side edge (point P) of the liquid surface of the ink In reaches the lower end of the sloped surface 43, the opposite side edge (point P') of the liquid surface of the ink In is spaced from the upper face of the nozzle substrate 22 (bottom face of the communication via 39) by the distance h2, in other words has not yet reached the bottom face of the communication via 39. Such a configuration suppresses an air bubble from residing inside the communication via 39. Thus, the condition that suppresses formation of a residual air bubble can be defined as "h2>0".

Figure 6A:
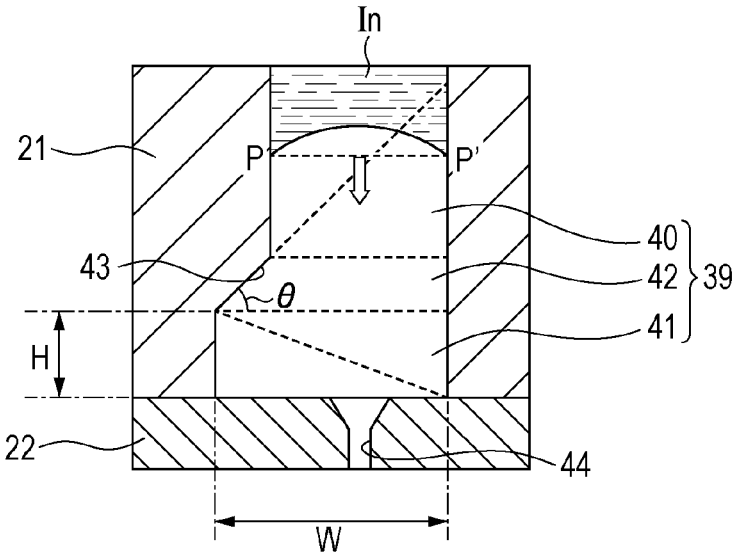
FIGS. 6A and 6B are cross-sectional views for explaining how ink is introduced into the communication via, according to another embodiment.
Figure 6B:
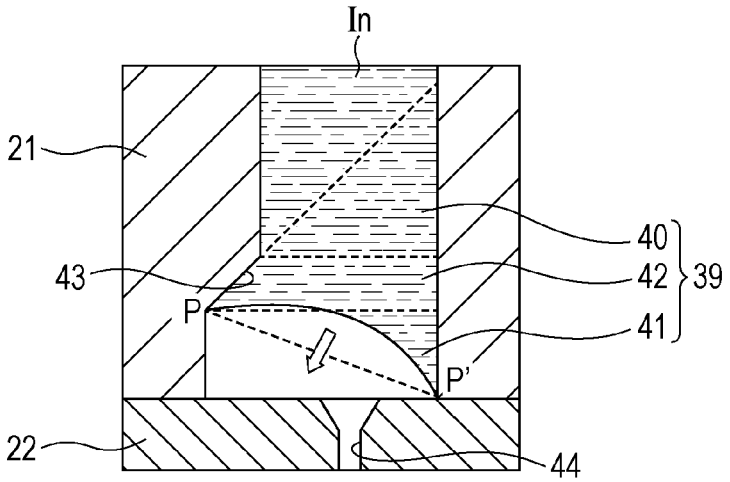
Figure 7A:
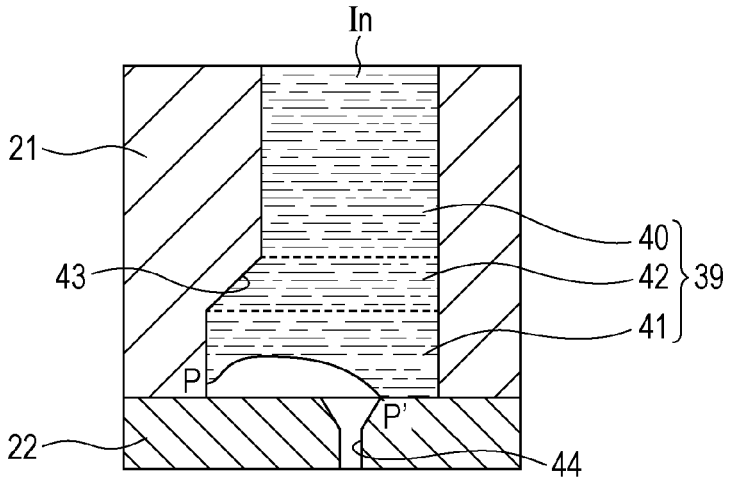
FIGS. 7A and 7B are cross-sectional views for explaining how ink is introduced into the communication via, according to another embodiment.
Figure 7B:
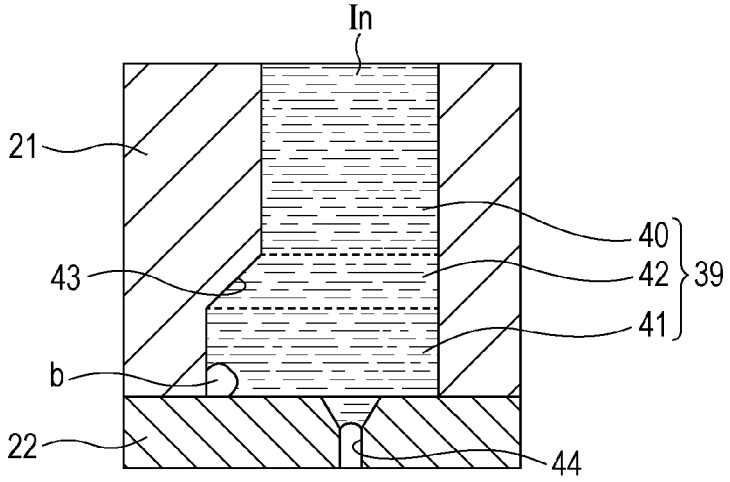
Figure 8A:
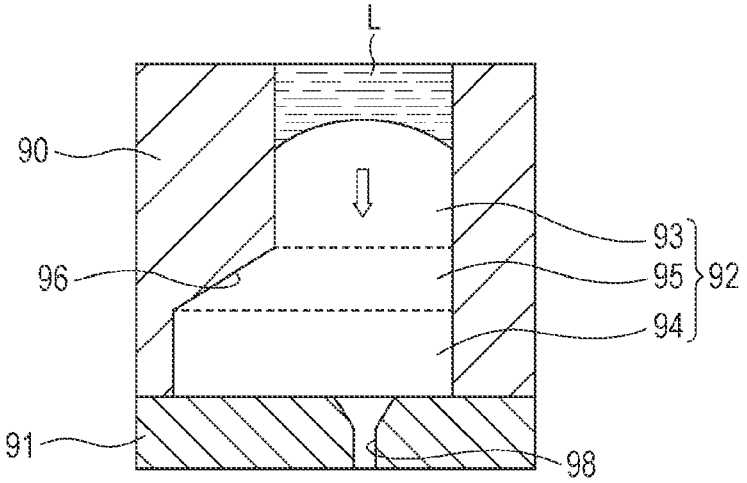
FIG. 8A PRIOR ART
FIGS. 8A and 8B are cross-sectional views for explaining how ink is introduced into a communication via, in a conventional liquid ejecting head.
Figure 8B:
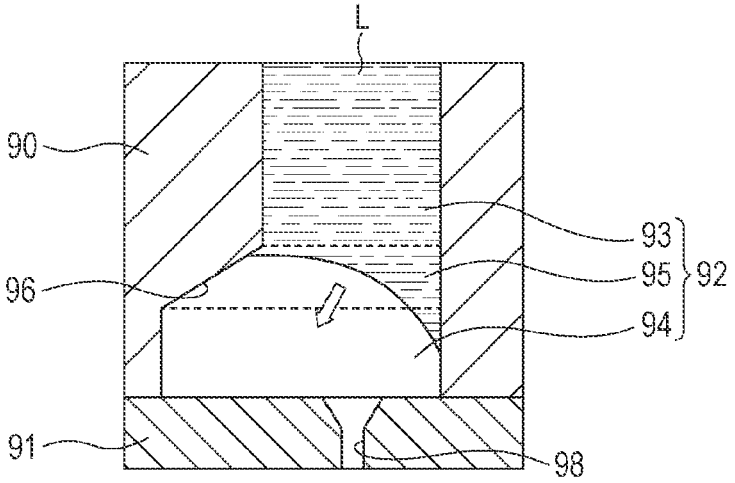
FIG. 8B PRIOR ART
Figure 9A:
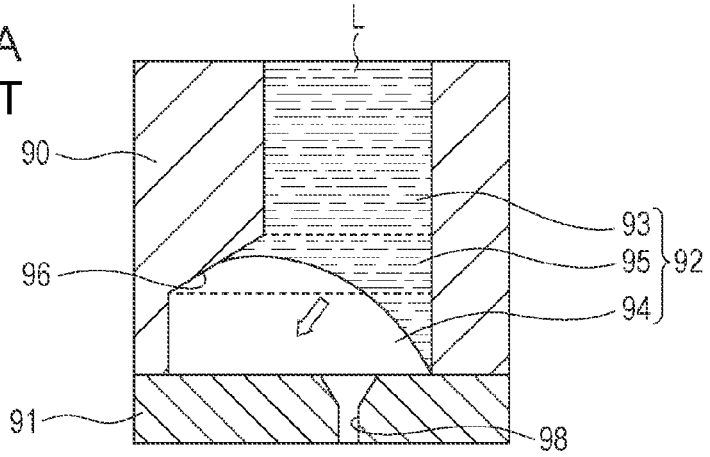
FIG. 9A PRIOR ART
FIGS. 9A to 9C are cross-sectional views for explaining how ink is introduced into the communication via, in the conventional liquid ejecting head.
Figure 9B:
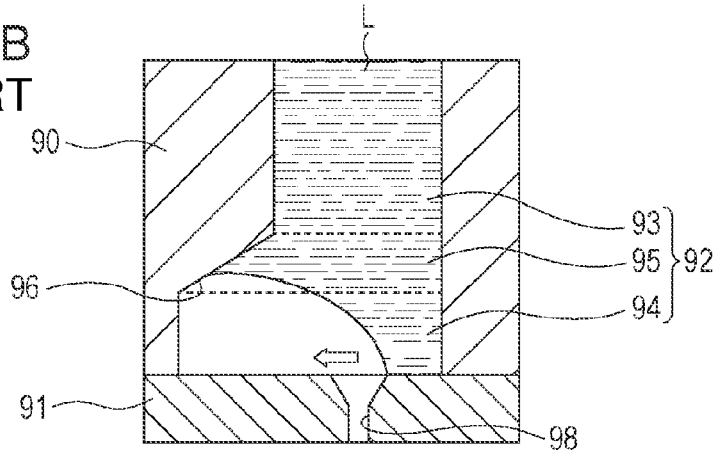
FIG. 9B PRIOR ART
Figure 9C:
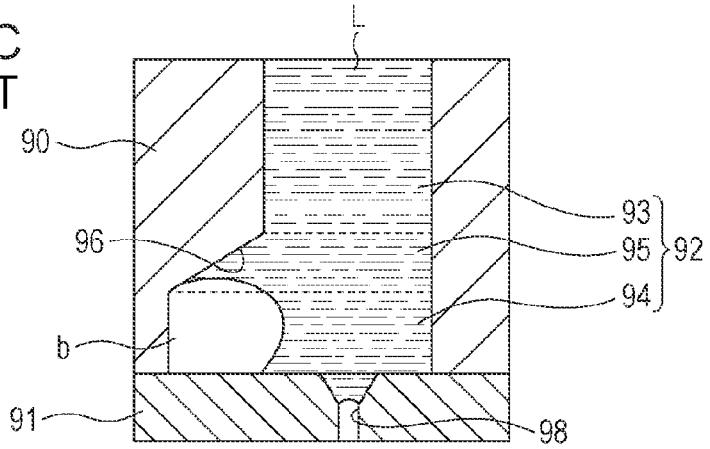
FIG. 9C PRIOR ART

Hereunder, the case where h2 is zero will be described. The communication via 39 shown in FIGS. 6A to 7B is configured such that the distance h2 becomes zero as shown in FIG. 6B. In other words, the opposite side edge (point P') of the liquid surface of the ink In reaches the bottom face of the communication via 39 at the same time as when the ink In moves downward until the side edge (point P) of the liquid surface of the ink In reaches the lower end of the sloped surface 43. In this case, as the side edge (point P) of the liquid surface of the ink In moves along the inner wall of the second flow path section 41, the opposite side edge (point P') of the liquid surface of the ink In moves along the bottom face of the communication via 39. Therefore, as shown in FIG. 7A, the opposite side edge (point P') of the liquid surface of the ink In first reaches the nozzle 44, and the ink In intrudes into halfway of the nozzle 44, thus to fill in the nozzle 44. Accordingly, a small amount of air may remain as a bubble b in the communication via 3, as shown in FIG. 7B. In this case, however, even though the air bubble b remains in the communication via 39, the air bubble b is smaller than an air bubble formed in the initial loading process of the conventional liquid ejecting head, and therefore the air bubble b can be easily discharged upon ejecting the ink In in a subsequent maintenance work such as flushing.

Thus, it has been proved that forming the communication via 39 such that the distance h2 becomes equal to or larger than zero is effective to suppress formation of a residual air bubble in the communication via 39. Referring now to FIG. 3A, a calculation method of the distance h2 will be described. In the cross-section of the communication via 39, the lower end of the sloped surface 43 (intersection between the inner walls of the sloped surface 43 and the second flow path section 41) will be denoted as C, the intersection between the extension of the sloped surface and the inner wall of the first flow path section 40 opposing the sloped surface 43 will be denoted as D, and the remaining corner of the isosceles triangle defined by the point D as the apex and the side CD as one of the equal sides will be denoted as E. Further, the intersection between an imaginary plane S passing the point C parallel to the bottom face of the communication via 39 (upper face of the nozzle substrate 22) and the inner wall of the communication via 39 opposing the sloped surface 43 will be denoted as F. In the cross-section of the communication via 39, when the side edge (point P) of the liquid surface of the ink In is located on the sloped surface 43, the liquid surface of the ink In becomes vertically symmetrical with respect to the line passing the midpoint between the sloped surface 43 and the opposite inner wall, i.e., the median of the isosceles triangle CDE drawn between the equal sides DC and DE. Accordingly, when the side edge (point P) of the liquid surface of the ink In reaches the lower end of the sloped surface 43 (point C), the opposite side edge (point P') of the liquid surface of the ink In reaches the point E, and therefore the distance between the point E and the bottom face of the communication via 39 corresponds to h2.

Since the angle DCF is θ, it is understood that the angle ECF is (π/4−θ/2) according to the geometric theory. In addition, when the length of the base CF of the right triangle ECF is denoted as W, the length of the side EF can be expressed as W tan(π/4−θ/2). Accordingly, the distance h2 can be obtained by calculating the distance between the point F and the bottom face of the communication via 39, i.e., the difference between the length of the second flow path section 41 H and the length of the side EF. Thus, the distance h2 can be obtained by the following equation.

$$h2=H-W\tan(\pi/4-\theta/2)$$

Upon applying the condition that suppresses formation of a residual air bubble (h2≥0) to the equation cited above, the foregoing equation (1) can be led out.

The boundary condition where the distance h2 becomes zero, can be obtained as follows, according to the geometric theory.

$$h/w=(W^2-H^2)/(2HW)$$

Therefore, the condition that suppresses formation of a residual air bubble can be expressed as the following equation (2):

$$h/w\geq(W^2-H^2)/(2HW) \quad (2)$$

As described above, in the case where the distance h2 is zero or small, a small air bubble may reside in the communication via 39. Therefore, it is preferable that the distance h2 has a certain length. In this respect, it has proved through simulations that an air bubble can be more securely prevented from residing in the communication via 39 in the case where the distance h2 is equal to or larger than a distance h3, where h3 represents a distance between the edge and the of the liquid surface of the ink In and the center thereof (top of the protruding shape), in the cross-section orthogonal to the extending direction the of pressure chamber 35 (cross-section taken along a line IIIB-IIIB in FIG. 3A). This condition will be explained below referring to FIG. 3B. In the cross-section orthogonal to the extending direction the of pressure chamber 35, the liquid surface of the ink In that has reached the second flow path section 41 assumes an arcuate shape protruding upward and symmetrical with respect to the line passing the midpoint between the inner walls on the respective sides of the second flow path section 41. Accordingly, in a cross-sectional view taken orthogonally to the extending direction of the pressure chamber 35, the liquid surface occupies a range corresponding to the distance h3 in the vertical direction. Reserving such a range as a margin assures that the opposite side edge P' of the liquid surface of the ink In does not yet reach the bottom face of the communication via 39 when the side edge P reaches the lower end of the sloped surface 43, as shown in FIG. 4B. In other words, setting the distance h2 to be equal to or larger than the distance h3 further assures that an air bubble is prevented from residing in the communication via 39.

The calculation of the distance h3 will be explained below. Regarding the cross-section orthogonal to the extending direction the of pressure chamber 35, the center of an imaginary circle including the arc formed by the liquid surface of the ink In will be denoted as O, and the intersection between an edge of the liquid surface of the ink In (left in FIG. 3B) and the inner wall of the second flow path section 41 will be denoted as Q, and the intersection between the opposite edge of the liquid surface of the ink In (right in FIG. 3B) and the inner wall of the second flow path section 41 will be denoted as Q'. Further, the intersection between the vertical line drawn from the center O toward the ink In and the line segment QQ' will be denoted as G. From the geometric theory, it is understood that the angle OQG is equal to ϕ which is the contact angle ϕ of the ink In with respect to the inner wall of the communication via 39. In addition, the length of the line segment QQ' corresponds to the width of the second flow path T in the direction orthogonal to the extending direction of the pressure chamber 35 (minimum width of the second flow path), and hence the length of the side QG is T/2. Accordingly, the length of the side OQ of the right triangle OQG, i.e., the radius of the imaginary circle can be expressed as (T/2)×(1/cos ϕ). Likewise, the length of the side OG can be expressed as (T/2)×(tan ϕ). Thus, the distance h3 can be obtained by calculating the difference between the length of the side OG and the radius of the imaginary circle. Consequently, the distance h3 can be expressed as the following equation:

$$h3=(T/2)\times(1/\cos\phi-\tan\phi)$$

Upon applying the condition h2≥h3 to the equation cited above, the foregoing equation (3) can be led out. Thus, it can be proved that the configuration that satisfies the equation (3) further assures that an air bubble is prevented from residing in the communication via 39.

The communication via 39 configured as above may be formed, in the case where stainless steel is employed to form the communication substrate 21, by punching the surface of the communication substrate 21 on the side of the second flow path section 41, with a punch smaller in diameter at the tip portion than at the base portion and including a surface corresponding to the sloped surface 43 formed at a halfway position. In the case where the communication substrate 21 is formed of silicon monocrystal, communication via 39 configured as above may be formed by an etching process. For example, the flow path sections may be formed by etching a silicon wafer having the crystal plane 110 on the substrate surface, so as to leave a plane 111 inclined by approximately 30 degrees with respect to the substrate surface, at the position corresponding to the sloped surface 43. In this case, since the crystal plane 111 can be utilized as the sloped surface 43, the communication via 39 configured as above can be easily formed.

Although the pressure generator is exemplified by the piezoelectric element 18 which is of a flexural vibration type in the foregoing embodiment, a vertical vibration type piezoelectric element may be employed instead. In addition, the invention is also applicable to the liquid ejecting heads that employ as the pressure generator a heating element that causes the ink to bump so as to create pressure fluctuation, or a static actuator that displaces the partition of the pressure chamber by static force thus to create pressure fluctuation.

The invention is not only applicable to the printer 1 incorporated with the ink jet recording head 2 exemplifying the liquid ejecting head, but broadly applicable to liquid ejecting apparatuses incorporated with different liquid ejecting heads. For example, the invention is also applicable to liquid ejecting apparatuses having a color material ejecting head for manufacturing color filters for LCDs, an electrode material ejecting head for manufacturing electrodes for organic electroluminescence (EL) displays or field emission displays (FED), and a bioorganic ejecting head for manufacturing biochips (biochemical elements).

This application claims priority to Japanese Patent Application No. 2012-269193 filed on Dec. 10, 2012. The entire disclosure of Japanese Patent Application No. 2012-269193 is hereby incorporated herein by reference.

What is claimed is:

1. A liquid ejecting head comprising:

a first member including a pressure chamber, a volume of the pressure chamber varying by operation of a pressure generator, and a communication flow path communicating with a downstream end portion of the pressure chamber;

a second member joined to a face of the first member to constitute a bottom face of the communication flow path and the second member including a nozzle communicating with the communication flow path, wherein the communication flow path includes a first flow path section that communicates with the pressure chamber, a second flow path section that communicates with the nozzle, a width of the second flow path section is wider than a width of the first flow path section, and an intermediate flow path section that includes a sloped surface formed between the first flow path section and the second flow path section, and an equation "$H-W\tan(\pi/4-\theta/2)\geq 0$" is satisfied in which H represents a length of the second flow path section, W represents a maximum width of the second flow path, and $\theta$ represents an angle between an imaginary plane parallel to the bottom face of the communication flow path and the sloped surface.

2. A liquid ejecting head comprising:

a first member including a pressure chamber, a volume of the pressure chamber varying by operation of a pressure generator, and a communication flow path communicating with a downstream end portion of the pressure chamber;

a second member joined to a face of the first member to constitute a bottom face of the communication flow path and the second member including a nozzle communicating with the communication flow path and, wherein the communication flow path includes a first flow path section that communicates with the pressure chamber, a second flow path section that communicates with the nozzle, a width of the second flow path section is wider than a width the first flow path section, and an intermediate flow path section that includes a sloped surface formed between the first flow path section and the second flow path section, and an equation "$h/w\geq(W^2-H^2)/(2HW)$" is satisfied in which H represents a length of the second flow path section, W represents a maximum width of the second flow path, h represents a length of the intermediate flow path section, and w represents a difference in width in the intermediate flow path section.

3. The liquid ejecting head according to claim 1, wherein an equation "$H-W\tan(\pi/4-\theta/2)\geq(T/2)\times(1/\cos\phi-\tan\phi)$" is satisfied, in which $\phi$ represents a contact angle of the liquid flowing in the communication flow path with respect to an inner wall of the communication flow path, and T represents a minimum width of the second flow path taken in a direction intersecting the direction of the maximum width.

4. A liquid ejecting apparatus comprising the liquid ejecting head according to claim 1.

5. A liquid ejecting apparatus comprising the liquid ejecting head according to claim 2.

6. A liquid ejecting apparatus comprising the liquid ejecting head according to claim 3.

* * * * *